US006954949B1

(12) United States Patent
Chen

(10) Patent No.: US 6,954,949 B1
(45) Date of Patent: Oct. 18, 2005

(54) PLAYPEN WITH DOUBLE COLUMNS AT EACH CORNER

(75) Inventor: Shun-Min Chen, Taipei Hsien (TW)

(73) Assignee: Wonderland Nurserygoods Co., Ltd., (TW)

( * ) Notice: Subject to any disclaimer, the term of this patent is extended or adjusted under 35 U.S.C. 154(b) by 0 days.

(21) Appl. No.: 10/827,563

(22) Filed: Apr. 19, 2004

(51) Int. Cl.[7] ..... A47D 13/06; A47D 7/00
(52) U.S. Cl. ..... 5/99.1; 5/98.1; 5/93.1
(58) Field of Search ..... 5/99.1, 98.1, 93.1

(56) References Cited

U.S. PATENT DOCUMENTS 6,539,563 B1 4/2003 Hsia

FOREIGN PATENT DOCUMENTS

AU 199957 133 B3 11/1999
JP 2000-60689 2/2000

*Primary Examiner*—Alexander Grosz
(74) *Attorney, Agent, or Firm*—Scully, Scott, Murphy & Presser

(57) ABSTRACT

A playpen with columns comprises a plurality of first corners each having a first bulge and a second bulge, a plurality of second corners each having a first sleeve and a second sleeve, a first rod unit connecting the first corners, a second rod unit connecting the second corners, a plurality of first columns whose one end bushes around the first bulge and another end thereof is inserted into the first sleeve, a plurality of second columns whose one end bushes around the second bulge and another end thereof is inserted into the second sleeve, and a boundary shelter unit covering the first columns. The distance between two opposite second columns is larger than that of two opposite first columns so that the second columns are revealed.

9 Claims, 5 Drawing Sheets

PLAYPEN WITH DOUBLE COLUMNS AT EACH CORNER

FIELD OF THE INVENTION

The present invention relates generally to a playpen, and more particularly to a playpen with multiple columns, such as possessing double columns at each corner of the playpen.

DISCUSSION OF THE PRIOR ART

A conventional playpen 3, generally of the kind disclosed in U.S. Pat. No. 6,539,563 B1 is shown in FIG. 1 of the present drawings. The conventional playpen 3 mainly consists of a rectangular frame 31 and a boundary sheet 33 covering five surfaces of the frame 31. The frame 31 has a pole 311 at respectively each of four nooks or corners, and the boundary sheet 33 completely covers all of the poles 311 such that the conventional playpen 3 is fully covered by the boundary sheet 33 in appearance and thus the visual feeling of the playpen abounding in various materials, such as metal and plastic, is not presently evident. Besides, the poles 311 fail to provide additional space for the arranging of any artificial decoration. Therefore, the conventional playpen 3 with one pole at each nook or corner, on the one hand, sets a limit in the forming of design patterns to the designer, while on the other hand failing to meet a variety of needs for various consumers.

Moreover, the conventional playpen 3, which is equipped with one pole at each nook or corner, needs poles with each possessing a larger diameter in order to meet requirements with respect to strength in construction, which make the conventional playpen 3 seem clumsy in appearance.

SUMMARY OF THE INVENTION

Accordingly, the present invention relates to a playpen equipped with double columns at each corner that are substantially intended to obviate one or more of the problems due to the limitations and disadvantages encountered in the prior art.

One object of the present invention is the provision of a playpen with columns which can provide a feeling of the structure abounding in a variety of materials.

Another object of the present invention is the provision of a playpen with columns which allows for the application of additional artificial decorations.

A further object of the present invention is the provision of a light and efficient playpen equipped with double columns at each corner.

Additional features and advantages of the invention will be set forth in the description which follows. The objectives and advantages of the invention will be realized and attained by the structure as particularly set forth in the written description and claims as well as illustrated in the appended drawings.

To achieve these and other advantages and according to the purpose of the present invention, as embodied and broadly described, the playpen with the double columns comprises: a plurality of first corners; a first rod unit connecting the first corners; a plurality of second corners; a second rod unit connecting the second corners; a plurality of first columns each having two opposite ends, one end being connected to the first corner, another end being connected to the second corner; a plurality of second columns each having two opposite ends, one end being connected to the first corner, another end being connected to the second corner; wherein the length of the two opposite second columns is larger than that of the two opposite first columns, and a gap exists between the adjacent first column and the second column and with a boundary sheet extending through each gap and covering the first columns.

In a preferred aspect, each second corner further comprises a first sleeve and a 20 second sleeve for respectively connecting with the first column and the second column.

Moreover, each first corner further comprises preferably a first bulge and a second bulge for respectively connecting with the first column and the second column. It is preferred that the columns respectively extend around the bulges.

It is another preferred feature that the playpen further comprises a plurality of rivets in order to secure the columns to respectively the first corners.

Additionally, the playpen further comprises a plurality of washers to secure the boundary sheet to respectively the ends of the first columns adjacent to the first corners.

It is to be understood that both the forgoing general description and the following detailed description are exemplary and explanatory and are intended to provide a further non-limiting explanation of the invention as claimed.

BRIEF DESCRIPTION OF THE DRAWINGS

The accompanying drawings, which are included to provide a further understanding of the invention and are incorporated in and constitute a portion of the specification, illustrate embodiments of the invention and together with the description serve to explain the principle of the invention. In the drawings.

DETAILED DESCRIPTION OF THE INVENTION

Figure 1:
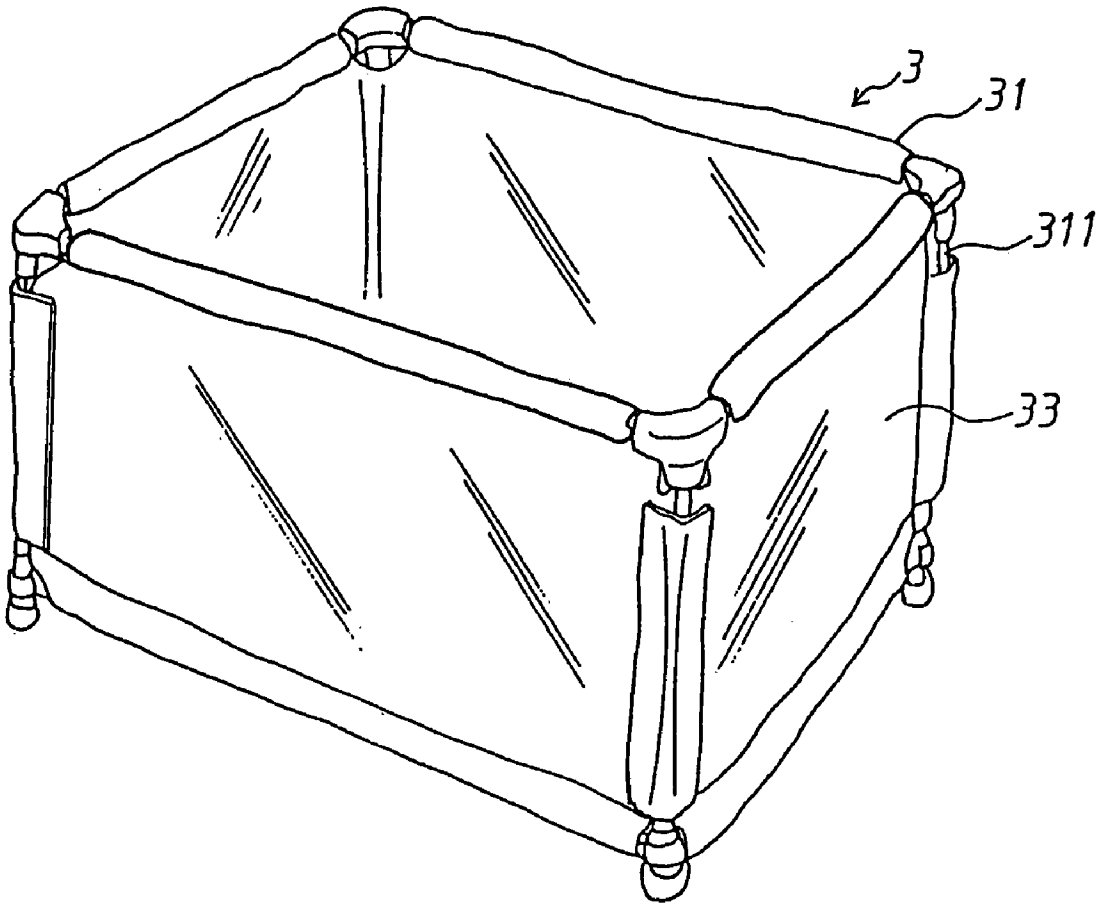
Fig. 1 PRIOR ART
FIG. 1 is an assembled perspective view illustrating a conventional playpen.
Figure 2:
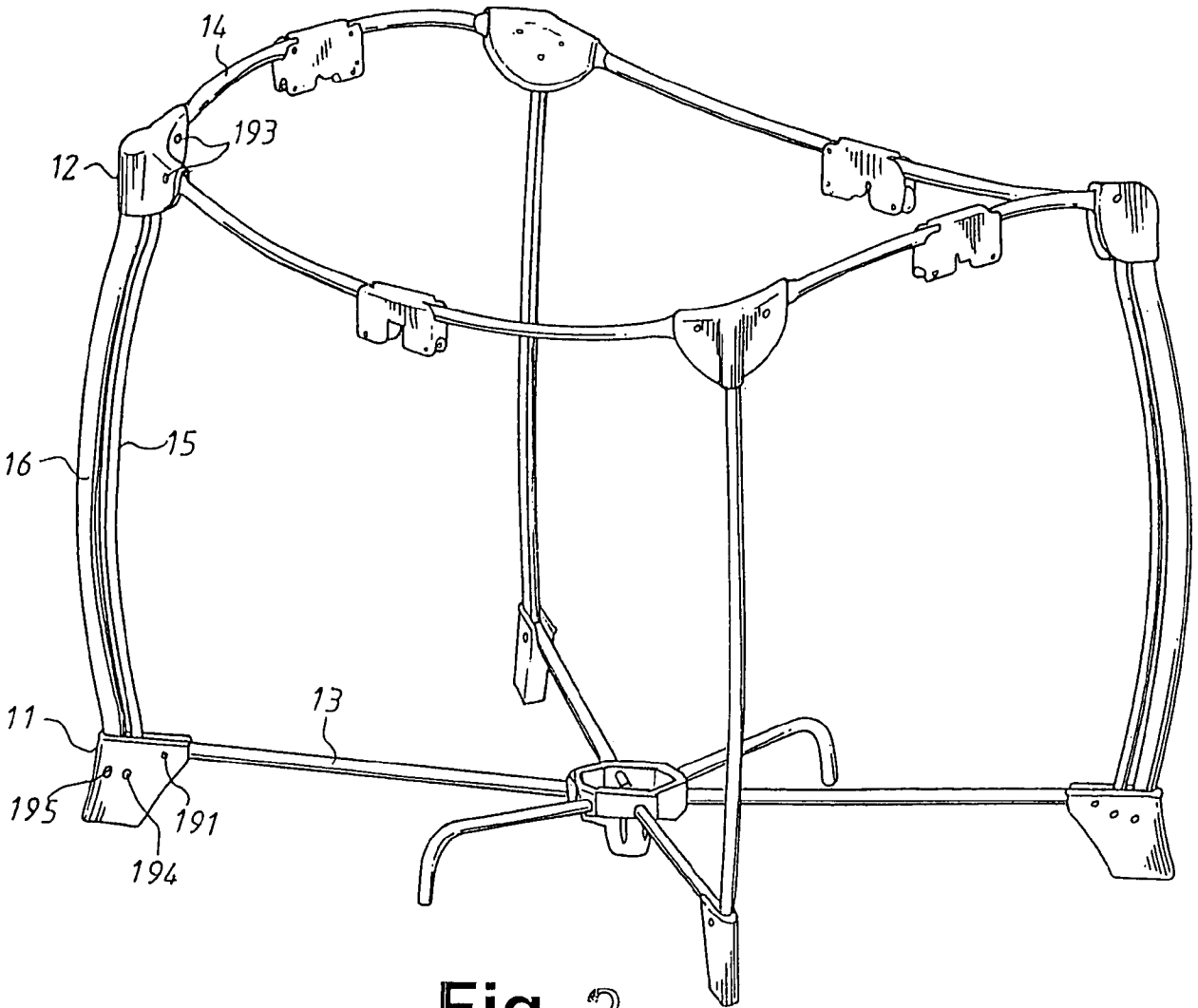
FIG. 2 is an assembled perspective view illustrating the frame of the playpen without a boundary shelter unit according to the present invention.
Figure 5:
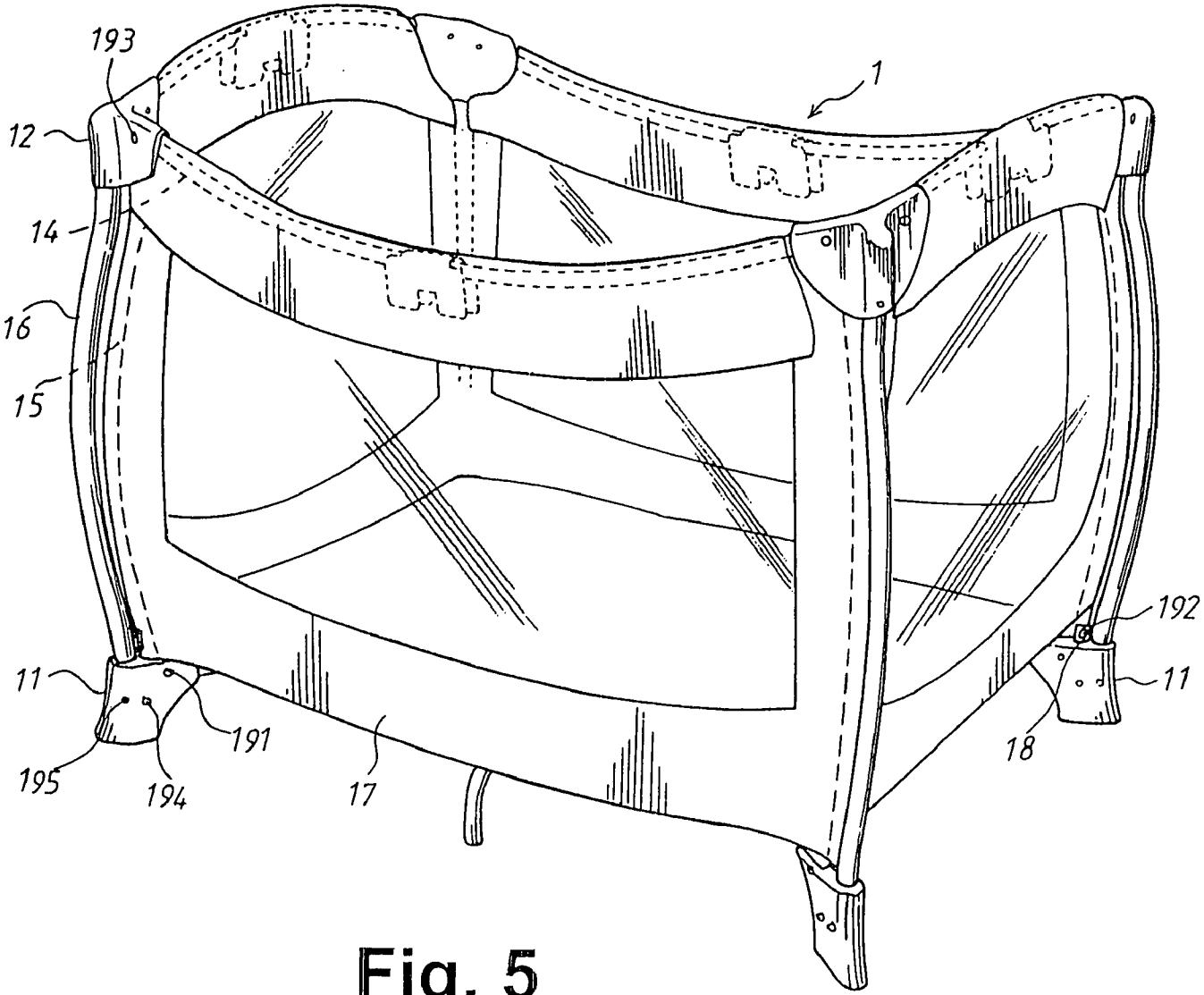
FIG. 5 is an assembled perspective view illustrating the playpen with double columns in the corners according to the present invention.

Referring to FIGS. 2 and 5, the playpen 1 with columns according to the present invention is substantially constructed as a rectangular body and comprises four first corner component 11 situated at lower end of the playpen 1, four second corner components 12 situated at upper end of the playpen 1, a first rod unit 13 laterally connecting the first corner components 11, a second rod unit 14 laterally connecting the second corner components 12, four first columns 15 and four second columns 16 vertically connecting the first corner components 11 and the second corner components 12, and a flexible boundary sheet 17 covering the bottom surface and four side surfaces of the playpen 1 together with the columns.

Figure 3:
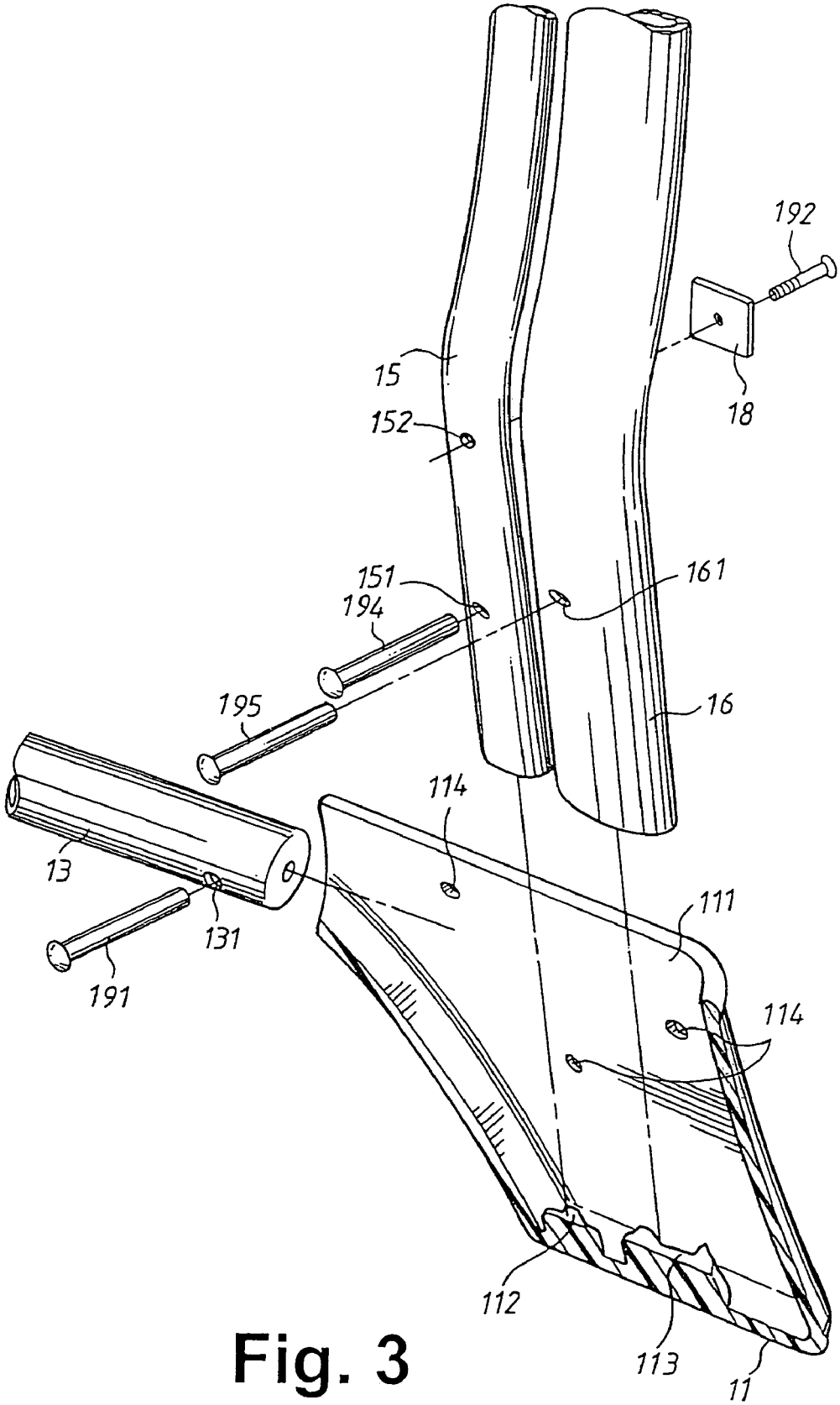
FIG. 3 is an exploded perspective view illustrating, on an enlarged scale, the first corner component near according to the present invention, wherein the first corner component is shown sectioned.

As shown in FIG. 3, each thin, flat and shell-like first corner component 11 includes an opening 111 provided at the upper end thereof, a first bulge 112 and a second bulge 113 extending upwardly from the bottom thereof, and three holes 114 provided in each sidewall thereof.

Figure 4:
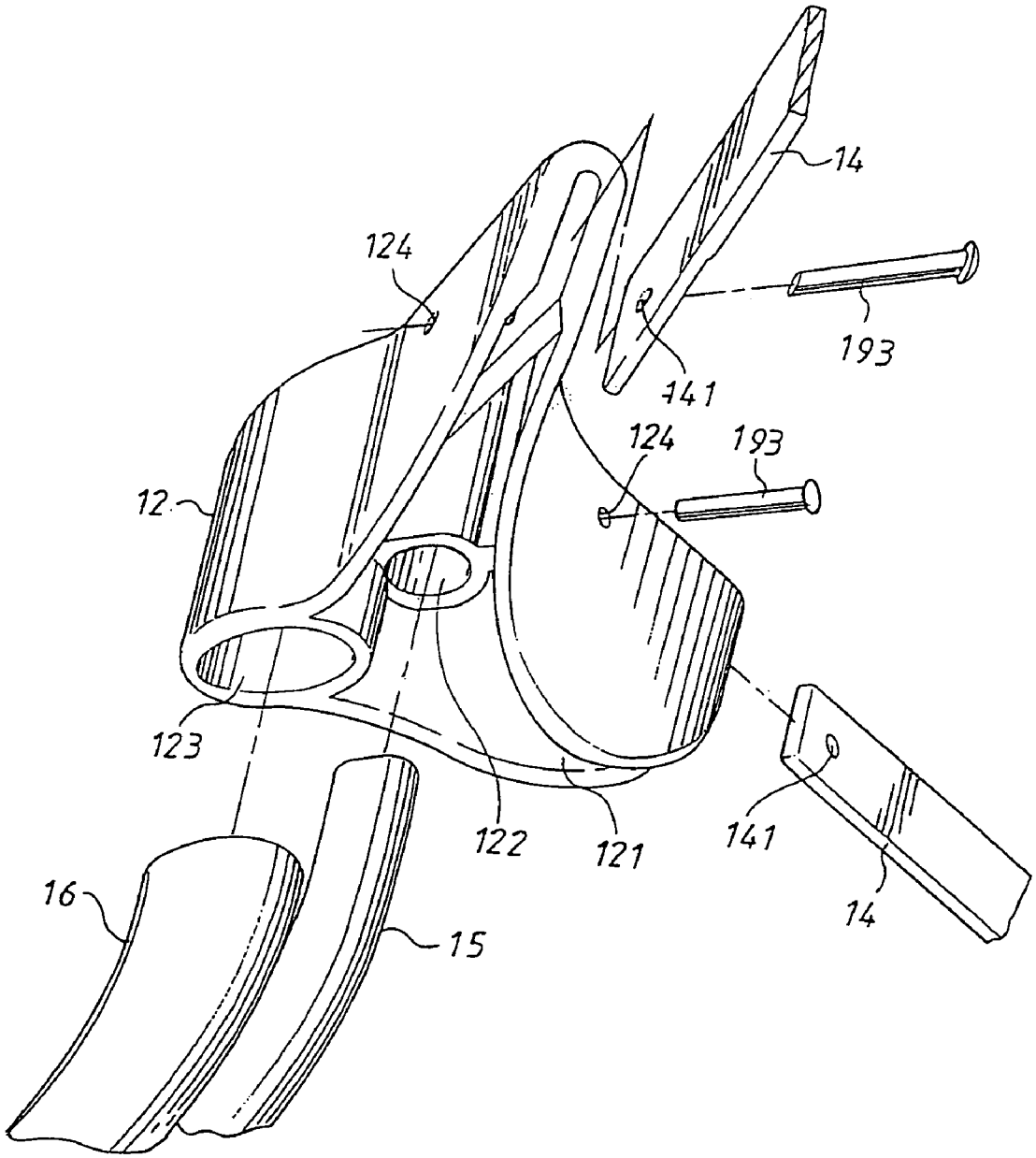
FIG. 4 is an exploded perspective view illustrating the second corner near according to the present invention.

As shown in FIG. 4, each second corner component 12 is substantially formed as a hollow triangular body and includes a slit 121 extending from the bottom end to two nooks thereof, a first sleeve 122 and a second sleeve 123 extending downwardly from the upper end thereof, and the apertures 124 provided in the sidewalls thereof.

Referring jointly to FIGS. 2 and 4, each rod of the first rod unit 13 is respectively inserted into the opening 111 of each first corner component 11. Then, a rivet 191 is respectively passed through the holes 114 of each first corner component 11 and the bore 131 of each rod of the first rod unit 13 50 as to pivotally connect the first rod unit 13 together with the four first corner components 11. Similarly, each rod of the second rod unit 14 is respectively inserted into the slit 121 of each second corner component 12. Then, a rivet 193 is respectively passed through the apertures 124 of each second corner component 12 and the aperture 141 in each rod of the second rod unit 14 so as to pivotally connect the second rod unit 14 with the four second corner components 12.

Thereafter, each first column 15 is respectively inserted downwardly into each first corner component 11 and washers around each first bulge 112. Then, a rivet 194 is respectively passed through the holes 114 of each first corner component 11 and the bore 151 of each first column 15 so as to connect each first column 15 with each first corner component 11. As far as the upper end of each first column 15, it is inserted into and secured by each first sleeve 122. Similarly, each second column 16 is respectively inserted downwardly into each first corner component 11 and washers around each second bulge 113. Then, a rivet 195 is respectively passed through the holes 114 of each first corner component 11 and the orifice 161 in each second column 16 so as to connect each second column 16 with each first corner component 11. As far as the upper end of each second column 16, it is inserted into and secured by each second sleeve 123. Having been assembled to this point, the rectangular frame shown in FIG. 2 of the playpen 1 with double columns is completed in its assembly, wherein the distance between two opposite second columns 16 is larger than that between two opposite first columns 15 and the diameter of the first column 15 is smaller than that of the second column 16. Besides, the adjacent first column 15 and second column 16 have similar convex profiles and are parallel to each other a gap remaining therebetween. However, the above description only represents a preferred embodiment of the present invention, whereas alternatively, or additionally, the number and profile of the first columns 15 and the second columns 16 may be varied depending on design considerations. Furthermore, the rods of the first rod unit 13, the rods of the second rod unit 14, the first columns 15, and the second columns 16 may be either solid or hollow in construction.

Referring jointly to FIGS. 2 and 5, the upper end of the boundary sheet 17 is secured entirely (or partially) to the second rod unit 14. The sidewalls of the boundary sheet 17 pass through each gap, which is present between each pair of adjacent first column 15 and second column 16, and simultaneously cover each first column 15. Then, a screw 192 is passed through a washer 18 of the playpen 1 and an aperture 152 (shown in FIG. 3) situated at the first column 15 so as to secure the boundary sheet 17 to the lower end of each first column 15 and unbend or straighten the whole boundary sheet 17. At the same time, since each second column 16 is not covered by the boundary sheet 17, the color and nature of the employed material, such as metal or plastic, can be exposed or artificial decorations can be added to each second column 16 in order to provide a designer with additional space for imparting a different visual feeling from any previous visual appearance for the boundary sheet 17.

This invention has been disclosed in terms of specific embodiments. It will be 25 apparent that many modifications can be made to the disclosed structures without departing from the invention. Therefore, it is the intent of the appended claims to cover all such variations and modifications as come within the breadth and scope of this invention.

What is claimed is:

1. A playpen with double columns at each corner of said playpen, comprising:

a plurality of first corner components;

a first rod unit connecting the first corner components;

a plurality of second corner components;

a second rod unit connecting the second corner components;

a plurality of first columns, each said first column having two opposite ends, one end being connected to a first corner component, another end of said column being connected to a second corner component;

a plurality of second columns, each said second column having two opposite ends, one end being connected to a first corner component, another end of said second column being connected to a second corner component each said second corner component comprising a first sleeve and a second sleeve connecting respectively with the first column and the second column;

wherein a distance between the two second columns is larger than that between the two first columns, whereby a gap is formed between an adjacent fist column and a second column; and a boundary sheet extends through each said gap and covers the first columns.

2. The playpen as claimed in claim 1, wherein each said first corner component comprises a first bulge and a second bulge connecting respectively with the first column and the second column.

3. The playpen as claimed in claim 2, wherein each of the first and second columns extend respectively around the first and second bulges.

4. The playpen as claimed in claim 1, wherein the playpen comprises a plurality of rivets for securing the first and second columns to respectively the first corner components.

5. The playpen as claimed in claim 1, wherein the playpen comprises a plurality of washers for securing the boundary sheet to respectively the ends of the first columns, which are adjacent to the first corner components.

6. A playpen with double columns at each corner of said playpen, comprising:

a plurality of first corner components;

a first rod unit connecting the first corner components;

a plurality of second corner components;

a second rod unit connecting the second corner components;

a plurality of first columns, each said first column having two opposite ends, one end being connected to a first corner component, another end of said column being connected to a second corner component;

a plurality of second columns, each said second column having two opposite ends, one end being connected to a first corner component, another end of said second column being connected to a second corner component, each said first corner component comprising a first bulge and a second bulge connecting respectively with the first column and the second column;

wherein a distance between the two second columns is larger than that between the two first columns, whereby a gap is formed between an adjacent first column and a second column; and a boundary sheet extends through each said gap and covers the first columns.

7. The playpen as claimed in claim 6, wherein each of the first and second columns extend respectively around the first and second bulges.

8. The playpen as claimed in claim 7, wherein the playpen comprises a plurality of rivets for securing the first and second columns to respectively the first corner components.

9. The playpen as claimed in claim 8, wherein the playpen comprises a plurality of washers for securing the boundary sheet to respectively the ends of the first columns, which are adjacent to the first corner components.

* * * * *